United States Patent [19]

Hirayama et al.

[11] Patent Number: 4,639,639

[45] Date of Patent: Jan. 27, 1987

[54] HIGH-PRESSURE SODIUM VAPOR LAMP AND TERNARY AMALGAM THEREFOR

[75] Inventors: Chikara Hirayama, Murrysville; Kenneth F. Andrew, Pittsburgh, both of Pa.

[73] Assignee: North American Philips Corporation, New York, N.Y.

[21] Appl. No.: 726,214

[22] Filed: Apr. 23, 1985

[51] Int. Cl.[4] ..... H01J 61/20

[52] U.S. Cl. ..... 313/639; 420/526

[58] Field of Search ..... 313/639, 640, 641, 490; 420/526

[56] References Cited

U.S. PATENT DOCUMENTS 3,384,798 5/1968 Schmidt ..... 313/639 X
4,298,813 11/1981 Johnson ..... 313/639
4,386,050 5/1983 Anderson ..... 313/639 X
4,422,011 12/1983 Bruninx-Poesen et al. .... 313/639 X

FOREIGN PATENT DOCUMENTS 678556 8/1979 U.S.S.R. ..... 313/639

*Primary Examiner*—Michael J. Tokar
*Assistant Examiner*—Joseph W. Roskos

[57] ABSTRACT

A high pressure sodium vapor lamp for operation at a sodium vapor pressure of at least 60 Torr and in which the start-up interval of variation of lamp operating voltage is reduced by charging the lamp with a ternary amalgam of mercury, sodium and a third metal selected from the group consisting of indium, gallium and tin. The atomic proportion of the third metal exceeds that of the mercury but does not exceed that of the sodium in the amalgam, and the atomic proportion of sodium is at least twice but not over four times that of the mercury.

13 Claims, 2 Drawing Figures

HIGH-PRESSURE SODIUM VAPOR LAMP AND TERNARY AMALGAM THEREFOR

BACKGROUND OF THE INVENTION

1. Field of the Invention

This invention relates to high-pressure sodium vapor lamps of the kind wherein arc discharge occurs in a vapor of sodium and mercury at a sodium vapor pressure of tens of Torr, and particularly to the composition of the amalgam which produces the requisite vapor for lamp operation.

2. Description of Related Art

The operating characteristics of sodium vapor electric discharge lamps are largely determined by the composition and pressure of the vapor as well as of the rare gas, such as neon, argon, xenon or mixtures thereof, which is included to initiate the arc discharge. A low pressure sodium lamp typically contains sodium vapor at a partial pressure of a few milli-Torr as well as starting gas at a pressure of about 20 Torr, and provides high luminous efficiency in the monochromatic yellow spectral region. Much broader spectral luminosity is achieved by the high-pressure sodium lamp, which contains mercury as well as sodium vapor in a sodium-to-mercury atomic ratio of 2 or 3:1. The requisite vapor is established by charging such lamps with sodium amalgam, the vapor pressure characteristics of which result in lamp operation at a mercury partial pressure of about one atmosphere (760 Torr) and a sodium partial pressure of at least 60 Torr, the latter usually not exceeding 80 Torr. However, the sodium radiation covers a broad band of color and exceeds the power radiated by the mercury in its characteristic ultraviolet spectral region. The mercury vapor increases the operating voltage of the lamp and reduces the current, thereby improving operating efficiency.

The operating life of a high-pressure sodium vapor ("HPS") lamp is an important reason for its commercial success, the rated life of a 400 watt HPS lamp being about 22,000 hours. A significant factor limiting the life is that the lamp operating voltage increases as the lamp is continued in service. This is due in large part to sputtering of the surface of the electrodes each time the lamp is turned on. Such sputtering results in the transport of electrode material, such as tungsten and the electron emissive coatings thereon, to the walls of the arc tube and causes blackening of the arc tube end-chamber. This raises the temperature of the tube, increasing the vapor pressure of the mercury and sodium therein. Applicants have found that the sputtering phenomenon is dependent on the time required for the lamp to reach its steady-state operating voltage after being turned on, and that more rapid attainment of the steady-state condition will result in decreased sputtering and therefore in increased lamp life.

It is known that the inclusion of various auxiliary metals in an electric discharge lamp can produce significant changes in the lamp operating characteristics. For example, U.S. Pat. No. 3,629,641, issued Dec. 21, 1971, discloses a low-pressure mercury vapor discharge lamp, e.g., a fluorescent lamp, in which the luminous efficiency is rendered less temperature dependent by incorporating indium or indium amalgam therein in an indium-to-mercury ratio of from 3:1 to 12:1 by weight. U.S. Pat. No. 3,678,315 issued July 18, 1972, discloses a low-pressure sodium vapor lamp in which the inclusion of indium in an atomic concentration exceeding that of the sodium reduces the temperature dependence of the sodium vapor pressure during lamp operation, thereby maintaining high luminous efficiency even when operating at high lamp current levels. However, the problem of electrode sputtering during start-up of a high-pressure sodium vapor lamp has not heretofore been resolved.

SUMMARY OF THE INVENTION

In accordance with the invention, the start-up interval of a high-pressure sodium vapor lamp, during which the lamp voltage gradually reaches the stable operating level, is reduced by providing therein as the source of the operative vapor a ternary amalgam consisting of sodium, mercury and a metal selected from the group consisting of indium, gallium and tin. Such metal is present in an atomic proportion at least equal to that of the mercury but not exceeding that of sodium in the amalgam, and the atomic proportion of the sodium is at least twice but not over four times that of the mercury. As compared with prior HPS lamps in which the operative vapor source is a binary amalgam of sodium and mercury, the start-up interval of the ternary amalgam lamp is about half as long. A further advantage of the ternary amalgam HPS lamp is that the total vapor pressure and the partial pressure of mercury therein are less temperature dependent than with binary amalgams. This reduces variations of the operating voltage with temperature, thereby simplifying the design of ballast circuits for controlling lamp voltage.

BRIEF OESCRIPTION OF THE DRAWING

DESCRIPTION OF THE PREFERRED EMBODIMENTS

Figure 1:
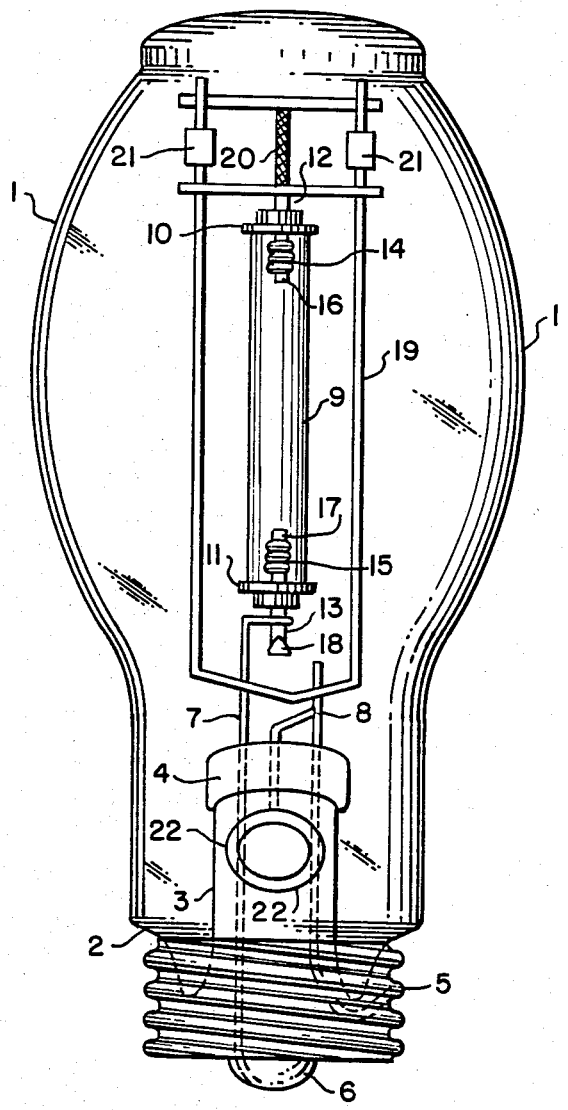
FIG. 1 is an elevation view of an HPS lamp which includes a ternary amalgam in accordance with the invention.

The lamp in FIG. 1 comprises an elongated light-transmissive sealed vitreous jacket 1, such as high temperature resistance borosilicate glass. Jacket 1 has a base assembly at its lower end comprising a narrow neck portion 2 sealed by a re-entrant stem 3 which is capped by a press 4. Affixed to neck portion 2, in conventional manner, is threaded shell 5 and insulated center contact 6 of a standard mogul screw base. A pair of stiff inlead conductors 7, 8 extend through stem 3 and are connected to shell 5 and contact 6. Positioned within jacket 1 is an elongated high pressure vapor arc discharge tube 9 of sintered polycrystalline alumina ceramic capable of withstanding the highly corrosive attack of sodium vapor. Discharge tube 9 contains under pressure the arc-producing medium comprising sodium and mercury vapor and a starting gas such as xenon. The ends of discharge tube 9 are sealed by thimble-like niobium metal end caps 10, 11 through which are welded niobium tubes 12, 13. Wound around and extending beyond the ends of tubes 12 and 13 are helical coils 14, 15 of tungsten wire in which are supported tungsten electrodes 16, 17. In order to obtain enhanced electron emission, metal oxides may be retained in the interstices between the turns of tungsten coils 14, 15. Lower niobium tube 13 is used to exhaust discharge tube 9 and to introduce the requisite charge of sodium and mercury and Xenon starting gas therein during manufacture. Tube 13 is then hermetically sealed by a weld 18, and serves as a reservoir for the excess amalgam which forms as a liquid pool during lamp operation.

Arc tube 9 is supported within jacket 1 by a metallic frame 19 which electrically connects inlead conductor 8 to upper niobium tube 12. The lower niobium tube 13 is electrically connected to inlead conductor 7. The connection between frame 19 and niobium tube 12 is made by a resilient braided conductor 20 to permit expansion and contraction of arc tube 9. Frame 19 is supported at the constricted dome of jacket 1 by resilient leaf spring-like members 21. The lamp also includes a barium-containing getter ring 22 which is flashed during lamp operation to obtain a vacuum operating environment for arc tube 9.

Initiation of arc discharge between electrodes 16, 17 requires a starting voltage pulse of 2 to 3 kilovolts. This ionizes the xenon gas, initiating current flow which raises the temperature in arc tube 9 and vaporizes the sodium and mercury therein. Arc discharge is then sustained by the ionized sodium and mercury vapor, and the operating voltage of the arc tube stabilizes at about 90–100 volts for a 400 watt lamp. Prior to the present invention, a typical discharge sustaining filling for arc tube 9 has been a sodium amalgam containing 21% sodium by weight and xenon gas at a pressure of 20 Torr. For a 400 watt lamp the amalgam weight is typically 33 mg. After initiation of arc discharge the lamp operating voltage will initially be considerably below the steady state operating level and will increase with increasing mercury vapor pressure as the temperature of the arc tube increases. This process typically continues for an interval of about 15–30 minutes until the mercury vapor pressure stabilizes, with consequent stabilization of the lamp operating voltage.

The changing voltage between electrodes 16, 17 causes sputtering of tungsten and electron emissive coatings thereon from the electrodes and from coils 14, 15 which deposits on the wall of arc tube 9 in the end-chamber regions thereof in the vicinity of the electrodes. Such sputtering continues until the operating voltage stabilizes, and the resultant blackening of the wall of arc tube 9 increases its temperature during lamp operation. This increases the mercury vapor pressure therein and consequently increases the lamp operating voltage. Since the process repeats each time the lamp is turned on, eventually the operating voltage reaches a level exceeding that available from the ballast circuit by which power is supplied to the lamp. The lamp will then cease to operate and must be replaced.

Figure 2:
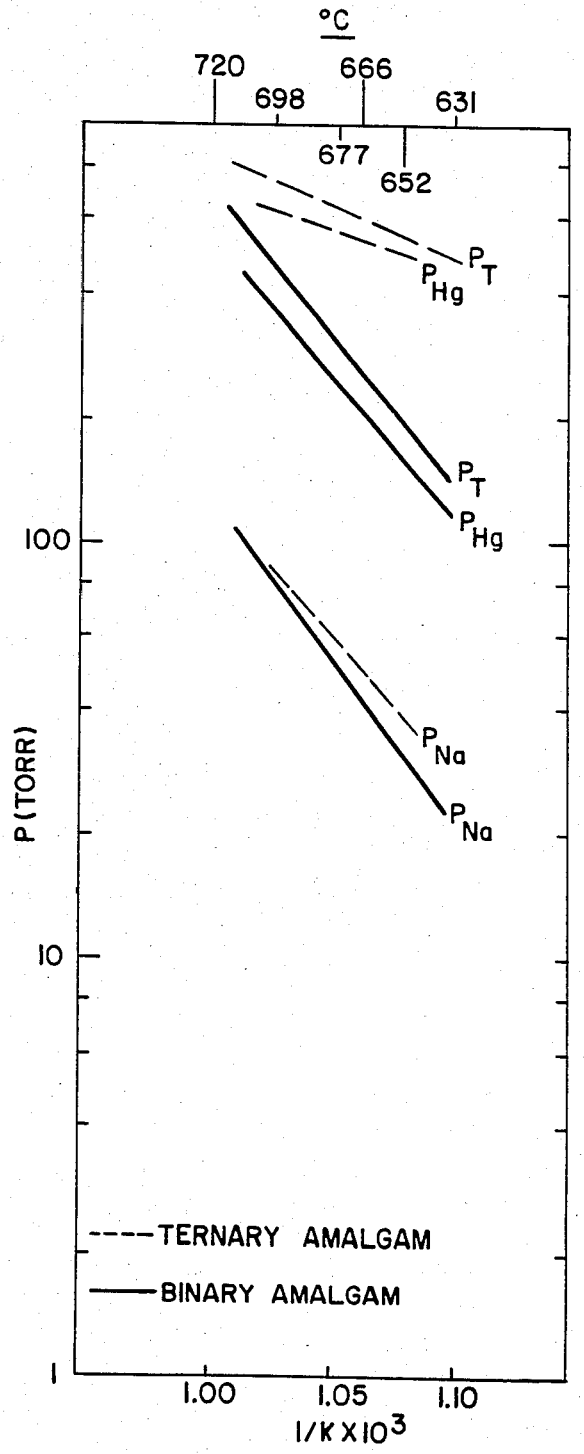
FIG. 2 is a graph showing the temperature variation of the vapor pressures of sodium and mercury in HPS lamps containing binary and ternary amalgams of sodium.

The increase in mercury vapor pressure during start-up of a 400 watt HPS lamp employing a binary sodium amalgam is shown by the solid $P_{Hg}$ curve in FIG. 2, wherein pressure in Torrs is plotted on a logarithmic scale against a linear scale of $10^3$ times the reciprocal of arc temperature in °K. The lamp was charged with 33 milligrams of a binary amalgam containing 21% sodium by weight (sodium/mercury atomic ratio of 2.32). It is seen that the mercury pressure increases from about 100 to 400 Torr as the temperature increases from about 630° C. to 720° C. The sodium vapor pressure $P_{Na}$ also increases, but is much less than that of the mercury vapor. This is evident from the total pressure curve $P_T$, which closely parallels the $P_{Hg}$ curve. The lamp operating voltage is therefore largely determined by the mercury vapor pressure, and the large variation in the latter with increasing temperature after the arc tube is started up inevitably results in a significant change in lamp operating voltage until the temperature stabilizes. As described above, this causes extensive sputtering of electrode material.

The luminous efficiency of HPS lamps with binary sodium amalgams also shows significant variation for lamps of identical power rating manufactured on a standard commercial production line. For example, using the same weight and composition of binary amalgam as described above, five such lamps rated at 400 watts were found to have relative luminous efficiencies of 100, 95, 108, 109 and 96 on a scale proportional to lumens/watts. The average luminous efficiency value was 102, with an average deviation of 5.6. This represents a significant manufacturing problem, since lamp performance should be essentially identical for all lamps of the same construction and power rating.

In accordance with the invention, in lieu of a binary amalgam of mercury and sodium the HPS lamp in FIG. 1 includes a ternary amalgam of mercury, sodium and one of the metals indium, tin or gallium. These metals all share two significant characteristics. First, low melting points; i.e., well below the temperature of approximately 650° C. at which the vapor pressure of sodium reaches the HPS lamp minimum operating level of about 60 Torr. Second, very low vapor pressures; i.e., negligible in comparison with that of the vapor pressure of sodium at the lamp operating temperature. The characteristic values are as follows:

| Metal (At. Wt.) | Melting Point (°C.) | Vapor Pressure (torr) at 650° C. |
|---|---|---|
| gallium (70) | 30 | $10^{-6}$ |
| indium (115) | 156 | $10^{-4}$ |
| tin (118) | 232 | $10^{-8}$ |
| sodium (23) | 98 | 60 |

The third metal can be provided by charging the arc tube with the ternary amalgam as such, or by charging it with a binary sodium amalgam as well as the requisite weight of third metal. In the latter case, the liquid ternary amalgam will form after arc discharge is initiated in the lamp. In either case, a fractional proportion of the mercury and sodium in the amalgam will vaporize and the excess amalgam will accumulate as a liquid in niobium tube 13 at the lower end of arc tube 9. Charging of arc tube 9 with the ternary amalgam or with the binary amalgam and the third metal is effected through tube 13 as described above.

The proportion of third metal in the amalgam must be sufficient to stabilize the vapor pressure of the mercury but not so high as to materially reduce the vapor pressure of the sodium. These criteria are met by a ternary amalgam in which the atomic proportion of the third metal at least equals that of the mercury but does not exceed that of the sodium, the atomic proportion of sodium being at least 2 and not ever 4 times that of the mercury component of the amalgam. In terms of percentages by weight of the ternary amalgam, this corresponds to a range of from 30% to 70% indium, 28% to 65% tin, and 17% to 34% gallium. The upper limits corresponding to the upper limit of the atomic proportion of sodium.

The performance of a 400 watt HPS lamp as in FIG. 1 was tested after being charged with 33 mg of a binary sodium amalgam containing 21% sodium by weight, 22 mg of indium, and xenon gas at a pressure of 20 Torr. The lamp attained its steady state operating voltage of about 100 volts in approximately one-half the time required by an identical lamp employing only a binary amalgam. Four such ternary amalgam lamps were manufactured on a standard production line and measured for luminous efficiency. The efficiencies were 110, 111, 106 and 108 on the same relative scale as had been used in the similar test described above of binary amalgam lamps. The average luminous efficiency value was 109, with an average deviation of 1.8. Thus, the efficiency is significantly greater than the corresponding binary amalgam lamps and is much more uniform among all lamps produced.

The broken line curves in FIG. 2 show the variation with temperature of the total vapor pressure (*PT*), mercury vapor partial pressure ($P_{Hg}$) and sodium vapor partial pressure ($P_{Na}$) of the ternary amalgam HPS lamp in FIG. 1. It is seen that the sodium vapor pressure is little affected but the mercury pressure over the ternary amalgam is significantly higher than over the binary amalgam at low temperatures and varies to a much lesser extent with increasing temperature. Since the total pressure is principally determined by the mercury vapor pressure, this results in much less variation in the operating characteristics of the lamp until the operating temperature reaches the stable operating condition after the lamp is turned on. The enhanced stability of operating pressure is the reason the lamp operating voltage reaches its steady state operating level much more rapidly than in a binary amalgam lamp.

Because of the relatively high proportion of the third metal in the ternary amalgam, the end-chamber wall of arc tube 9 in the vicinity of electrode 15 and its coil 17 will become coated with a thin film of that metal or a binary amalgam thereof. This film aids in maintaining the temperature of the reservoir in tube 13 nearly uniform for all ternary amalgam lamps of the same power rating. Consequently, there is much less variation in operating voltage between such lamps and they will tend to operate at a uniform voltage somewhat higher than the average operating voltage of binary amalgam lamps of the same power rating.

While the invention has been described with reference to certain preferred embodiments thereof, it will be obvious to those skilled in the art that various modifications and adaptations thereof may be made without departing from the true spirit and scope of the invention as defined in the ensuing claims.

What is claimed is:

1. A high pressure sodium vapor lamp for operation at a sodium vapor pressure of at least 60 Torr, such lamp comprising an arc discharge tube containing a ternary amalgam of mercury, sodium and a third metal selected from the group consisting of indium, gallium and tin, the atomic proportion of the third metal exceeding that of the mercury but not exceeding that of the sodium in the amalgam, and the atomic proportion of the sodium being at least twice but not over four times that of the mercury.

2. A high pressure sodium vapor lamp in accordance with claim 1 wherein the third metal is indium and constitutes between 30 percent and 70 percent of the ternary amalgam by weight.

3. A high pressure sodium vapor lamp in accordance with claim 1 wherein the third metal is gallium and constitutes between 17 percent and 34 percent of the ternary amalgam by weight.

4. A high pressure sodium vapor lamp in accordance with claim 1 wherein the third metal is tin and constitutes between 28 percent and 65 percent of the ternary amalgam by weight.

5. A high pressure sodium vapor lamp for operation at a sodium vapor pressure of at least 60 Torr, such lamp comprising an arc discharge tube charged with (i) a binary amalgam of mercury and sodium and (ii) a third metal selected from the group consisting of indium, gallium and tin and which forms a ternary amalgam with the mercury and sodium during lamp operation; the atomic proportion of the third metal exceeding that of the mercury but not exceeding that of the sodium in the amalgam, and the atomic proportion of the sodium being at least twice but not over four times that of the mercury.

6. A high pressure sodium vapor lamp in accordance with claim 5, wherein the sodium constitutes at least 20 percent by weight of the binary amalgam.

7. A high pressure sodium vapor lamp in accordance with claim 6, wherein the third metal is indium and constitutes at least 30 percent by weight of the ternary amalgam.

8. A high pressure sodium vapor lamp in accordance with claim 6, wherein the third metal is gallium and constitutes at least 17 percent by weight of the ternary amalgam.

9. A high pressure sodium vapor lamp in accordance with claim 6, wherein the third metal is tin and constitutes at least 28 percent by weight of the ternary amalgam.

10. A ternary amalgam for producing the operative vapor in a high pressure sodium vapor lamp wherein the sodium vapor pressure is at least 60 Torr, such amalgam consisting of mercury, sodium and a third metal selected from the group consisting of indium, gallium and tin, the atomic proportion of the third metal exceeding that of the mercury but not exceeding that of the sodium in the amalgam, and the atomic proportion of the sodium being at least twice but not over four times that of the mercury.

11. A ternary amalgam in accordance with claim 10, wherein the third metal is indium and constitutes between 30 percent and 70 percent of the ternary amalgam by weight.

12. A ternary amalgam in accordance with claim 10, wherein the third metal is gallium and constitutes between 17 percent and 34 percent of the ternary amalgam by weight.

13. A ternary amalgam in accordance with claim 10, wherein the third metal is tin and constitutes between 28 percent and 65 percent of the ternary amalgam by weight.

* * * * *